US005324129A

United States Patent [19]

Root

[11] Patent Number: 5,324,129

[45] Date of Patent: Jun. 28, 1994

[54] PIVOT HEAD TOOTHBRUSH WITH MIRROR

[76] Inventor: Todd J. Root, P.O. Box 116, Wesley, Ark. 72773

[21] Appl. No.: 75,611

[22] Filed: Jun. 14, 1993

[51] Int. Cl.[5] ..... A46B 11/02

[52] U.S. Cl. ..... 401/195; 15/172; 132/309; 401/176; 401/190; 401/278; 401/281

[58] Field of Search ..... 401/176, 190, 278, 195, 401/281; 132/309; 15/172

[56] References Cited

U.S. PATENT DOCUMENTS

| | | | |
|---|---|---|---|
| 1,172,109 | 2/1916 | Cammack | 15/172 |
| 1,325,268 | 12/1919 | Sosdian | 401/278 |
| 1,439,913 | 12/1922 | Saxe | 15/172 |
| 1,442,363 | 1/1923 | Saxe | 15/172 |
| 1,944,067 | 1/1934 | Collins | 401/175 |
| 2,047,613 | 7/1936 | Brown | 15/172 |
| 2,241,584 | 5/1941 | Cohen | 132/309 |
| 2,609,251 | 9/1952 | Haupt | 15/172 X |
| 2,790,190 | 4/1957 | Mastrandrea | 401/190 X |
| 3,659,951 | 5/1972 | Germann | 401/190 |
| 4,403,623 | 9/1983 | Mark | 15/172 |

FOREIGN PATENT DOCUMENTS

| | | | |
|---|---|---|---|
| 430270 | 6/1935 | United Kingdom | 132/309 |

*Primary Examiner*—Steven A. Bratlie
*Attorney, Agent, or Firm*—E. Michael Combs

[57] ABSTRACT

A toothbrush having an elongate support shaft includes a brush head arranged for rotation and latching in a plurality of orientations relative to the support shaft to permit ease of access to various portions of an individual's teeth during a brushing procedure.

1 Claim, 4 Drawing Sheets

PIVOT HEAD TOOTHBRUSH WITH MIRROR

BACKGROUND OF THE INVENTION

1. Field of the Invention

The field of invention relates to toothbrush apparatus, and more particularly pertains to a new and improved pivot head toothbrush wherein the toothbrush includes a head structure arranged for pivotal mounting relative to the toothbrush support shaft and handle.

2. Description of the Prior Art

Toothbrushes of various types have been utilized throughout the prior art and exemplified by the U.S. Pat. Nos. 4,471,506; 5,033,154; 5,052,071; and 5,115,530.

The instant invention attempts to overcome deficiencies of the prior art by providing for a toothbrush structure wherein the same permits the pivotal rotation and latching of a toothbrush head relative to the toothbrush support shaft and in this respect, the present invention substantially fulfills this need.

SUMMARY OF THE INVENTION

In view of the foregoing disadvantages inherent in the known types of toothbrush structure now present in the prior art, the present invention provides a pivot head toothbrush wherein the same includes a toothbrush head arranged for pivotal mounting in a plurality of orientations relative to the supporting shaft of the toothbrush structure. As such, the general purpose of the present invention, which will be described subsequently in greater detail, is to provide a new and improved pivot head toothbrush which has all the advantages of the prior art toothbrush structure and none of the disadvantages.

To attain this, the present invention provides a toothbrush having an elongate support shaft including a brush head arranged for rotation and latching in a plurality of orientations relative to the support shaft to permit ease of access to various portions of an individual's teeth during a brushing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pivot head toothbrush which has all the advantages of the prior art toothbrush structure and none of the disadvantages.

It is another object of the present invention to provide a new and improved pivot head toothbrush which may be easily and efficiently manufactured and marketed.

It is a further object of the present invention to provide a new and improved pivot head toothbrush which is of a durable and reliable construction.

An even further object of the present invention is to provide a new and improved pivot head toothbrush which is susceptible of a low cost of manufacture with regard to both materials and labor, and which accordingly is then susceptible of low prices of sale to the consuming public, thereby making such pivot head toothbrushes economically available to the buying public.

Still yet another object of the present invention is to provide a new and improved pivot head toothbrush which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
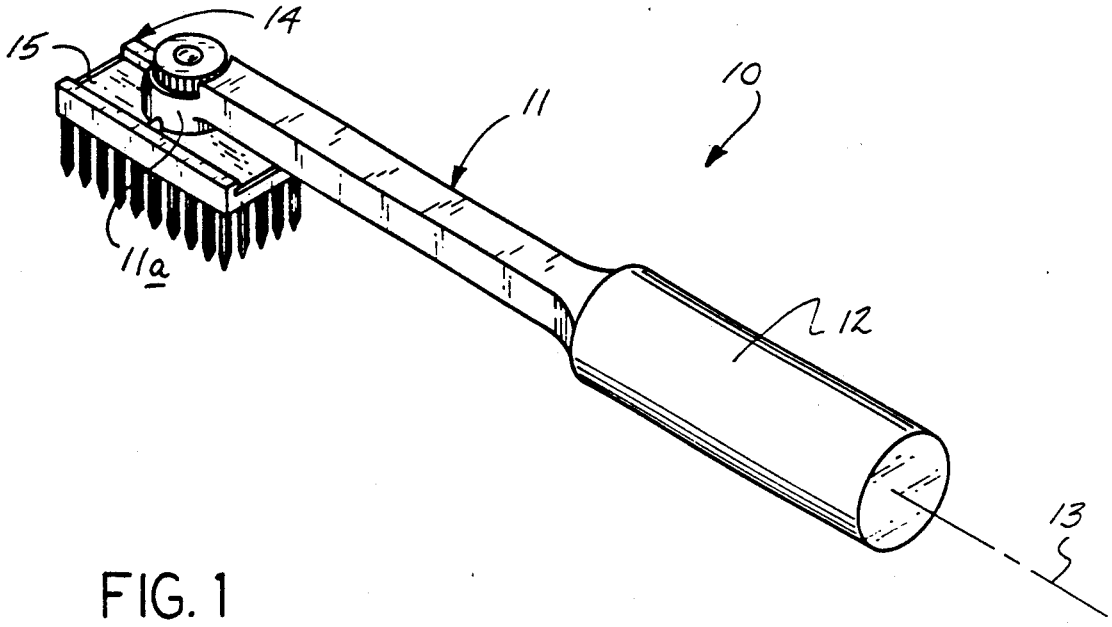
FIG. 1 is an isometric illustration of the invention.
Figure 2:
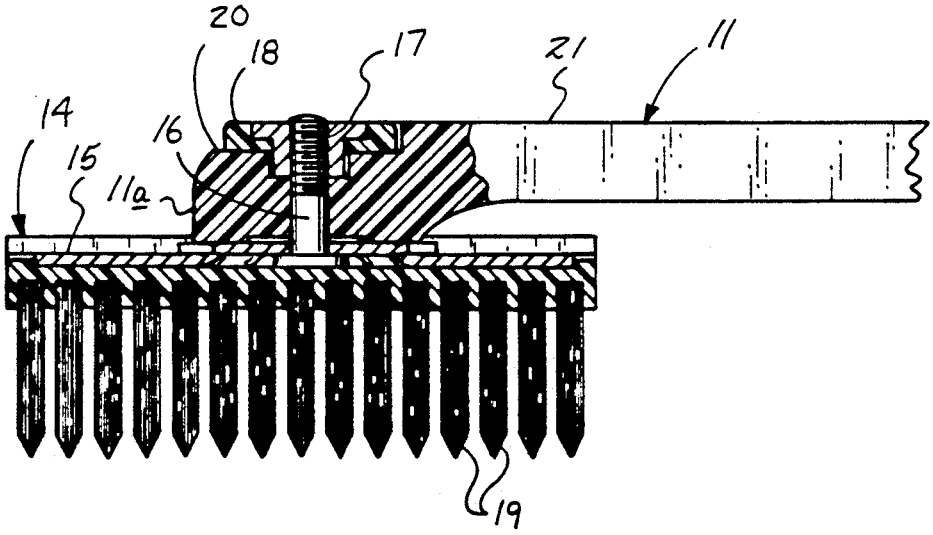
FIG. 2 is an enlarged orthographic view, partially in section, of the toothbrush head and its association to the support shaft.

With reference now to the drawings, and in particular to FIGS. 1 to 8 thereof, a new and improved pivot head toothbrush embodying the principles and concepts of the present invention and generally designated by the reference numeral 10 will be described.

Figure 3:
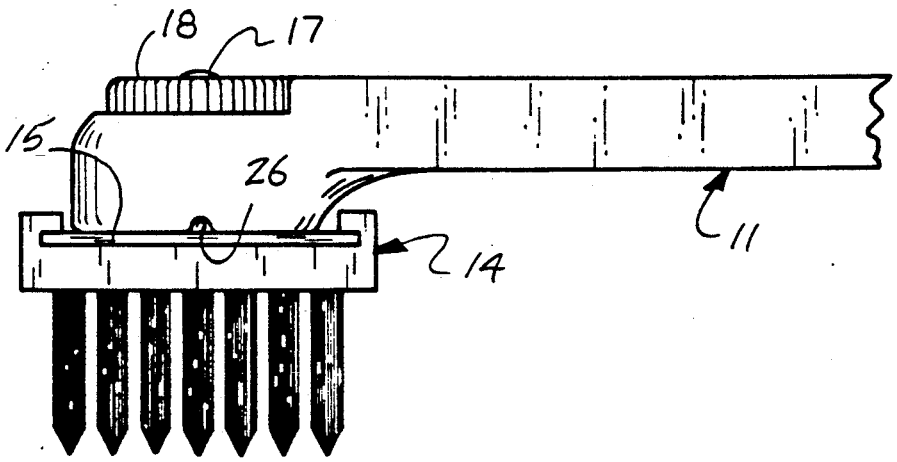
FIG. 3 is an orthographic view of the toothbrush head mounted in a rotated orientation relative to the toothbrush supporting shaft.
Figure 4:
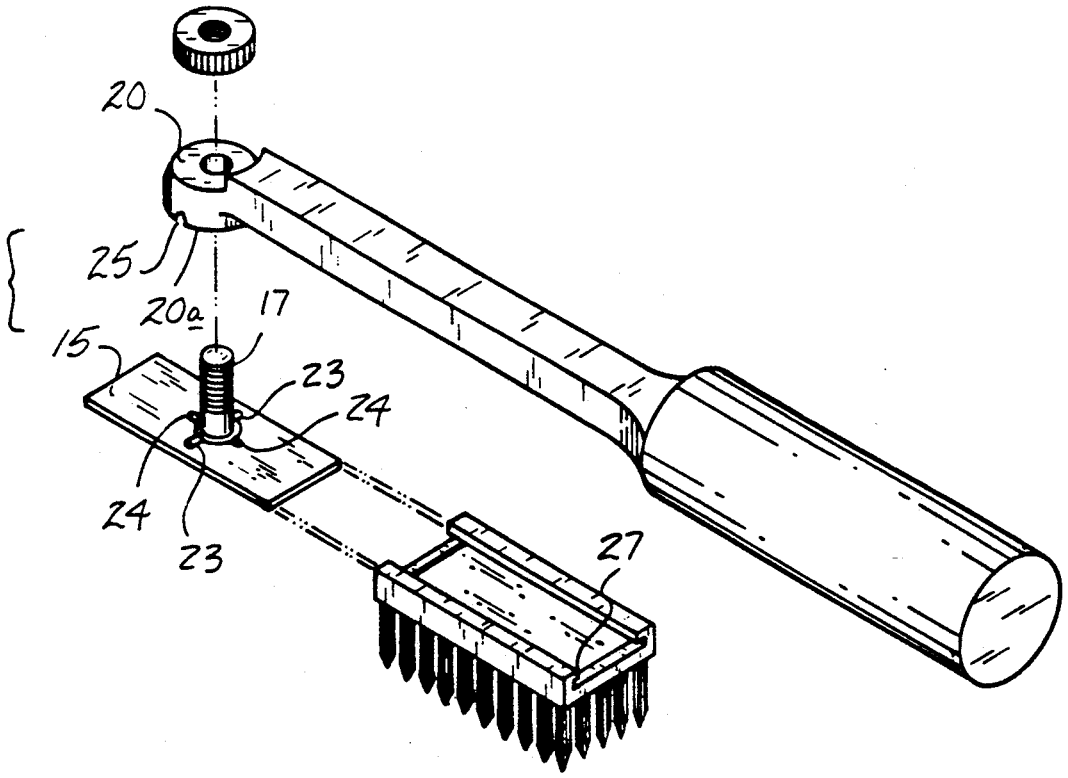
FIG. 4 is an isometric illustration of the invention.

More specifically, the pivot head toothbrush 10 of the instant invention essentially comprises a support shaft 11 having a handle 12 mounted at a first end of the support shaft coaxilly aligned along an axis 13 directed through the support shaft 11 and the handle 12. A brush head 14 is rotatably mounted to the support shaft 11 at its second end, wherein a support shaft head 11*a* is integral with the support shaft second end and includes a support shaft head recess floor 20 spaced from and parallel a support shaft head face plate 20*a*. The support shaft head recess floor, as well as the support shaft head face plate 20 and 20*a*, are arranged parallel to the axis 13. The support shaft head face plate 20*a* is arranged to engage the brush head top wall plate 15, that in turn is fixedly mounted within a brush head track 27 typically employing adhesives and the like. In this manner, such adhesives are disengaged by utilizing appropriate adhesive solid for that adhesive to permit replacement of the brush head bottom wall bristles 19 projecting orthogonally from the brush head bottom wall. A top wall plate shaft 16 orthogonally and medially oriented relative to the top wall plate 15 is also orthogonally oriented relative to the axis 13 and is rotatably received through the support shaft head 11*a*, with a fastener dial 18 threadedly mounted upon the top wall plate shaft threaded end portion 17. The fastener dial 18 is of a predetermined thickness substantially equal to a predetermined spacing oriented between the support shaft head recess floor and the support shaft head face plate 20 and 20*a* respectively to provide for an unobstructed support shaft top wall 21. A plurality of first ribs 23 (see FIG. 4) are linearly aligned in a spaced relationship and are concentric about the top wall plate shaft 16, with a plurality of second ribs 24 radially directed to the top wall plate shaft 16 and linearly aligned relative to one another, as well as orthogonally oriented relative to the first ribs 23. In this manner, the support shaft head face plate 20*a* includes respective first and second recesses 25 and 26 orthogonally oriented relative to one another to receive the first and second ribs 23 and 24. When the brush head 14 is longitudinally aligned relative to the support shaft 11, the first and second recesses 25 and 26 receive the first and second ribs 23 and 24 respectively, whereupon rotation with the longitudinal alignment of the brush head 14 orthogonally oriented relative to the axis 13, the first and second ribs 23 and 24 are received within the respective second and first recesses 26 and 25 respectively, as indicated in FIG. 3 for example.

Figure 5:
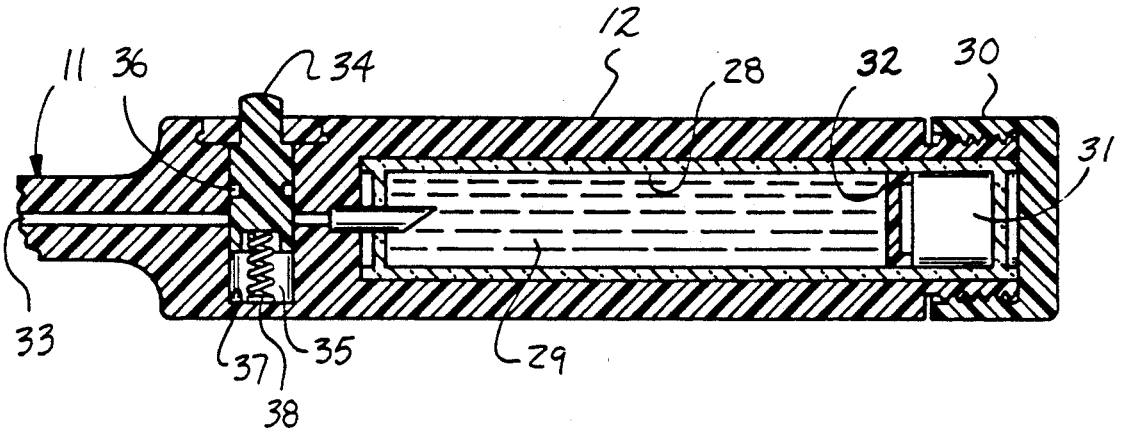
FIG. 5 is an enlarged cross-sectional illustration of the handle structure of the invention.
Figure 6:
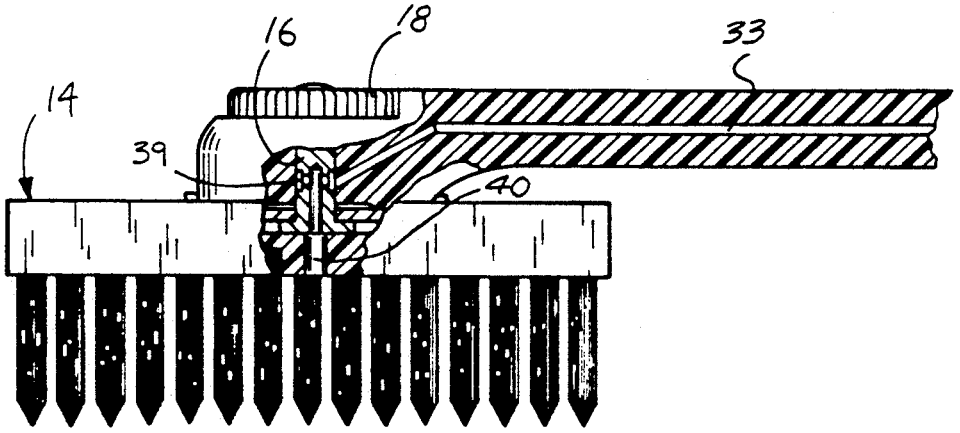
FIG. 6 is an enlarged orthographic view, partially in section, of the shaft and head structure indicating a cooperative conduit directed therethrough.

The FIGS. 5 and 6 indicate the use of the handle 12 having handle reservoir cavity 28 containing a mouthwash fluid 29 of any commercially available type, such that a handle cap 30 includes a compressed gas canister 31 having a piston plate 32 in confrontation within the handle reservoir cavity 28, whereupon release of the mouthwash fluid 29 pressurized within the cavity 28 by the cartridge 31, the piston plate 32 projects along the reservoir cavity to enhance compression of the fluid. A delivery conduit 33 extends in communication with the reservoir cavity 28 through the support shaft 11 by means of a valve plunger 34 contained within a valve plunger cavity 35, that in turn is orthogonally oriented relative to the axis 13 and positioned between the cavity 28 and the support shaft 11, such that the valve plunger cavity 35 includes a plunger cavity floor 37 having a spring 38 captured between the valve plunger 34 and the cavity floor 37, with an annular feed groove 36 arranged circumferentially about the valve plunger 34 for communication with the delivery conduit 33 when the valve plunger is directed into the cavity 35 to compress the spring 38. In this manner, the mouthwash fluid is directed through the delivery conduit 33 and through a plate shaft conduit 39 directed through the plate shaft 16 in fluid communication with the delivery conduit 33. The plate shaft conduit 39 includes an outlet port 40 directed through the brush head bottom wall for communication with the bristles to direct such mouthwash against an individual's teeth during a brushing procedure.

Figure 7:
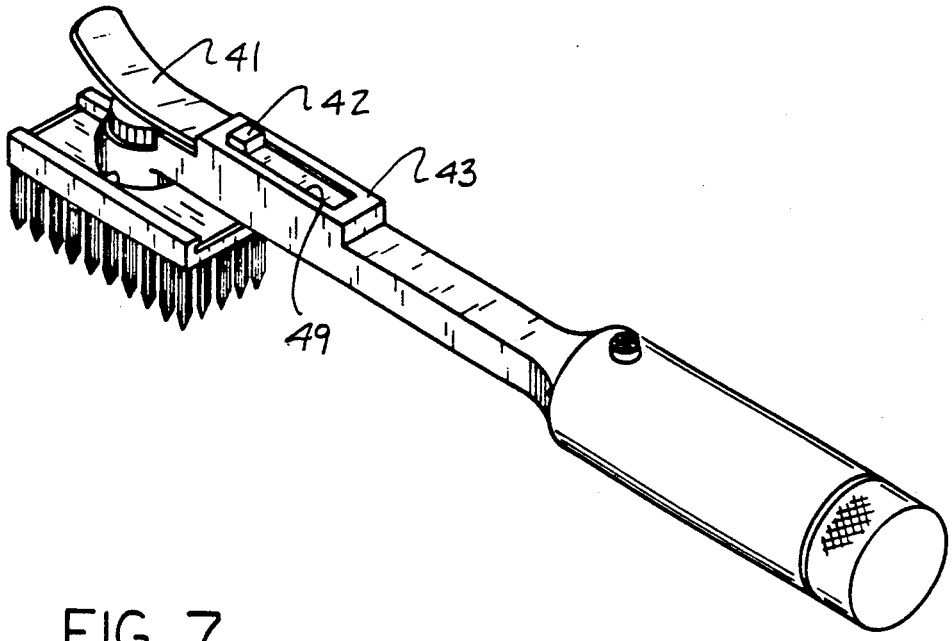
FIG. 7 is an isometric illustration of the invention further including a mirror plate structure for oral examination.
Figure 8:
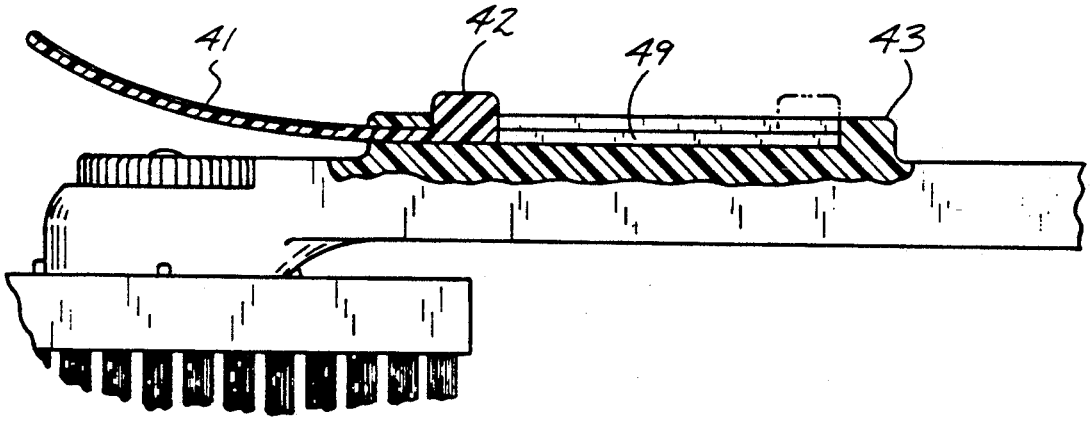
FIG. 8 is an enlarged orthographic view, particularly in section, of the mirror plate structure as indicated in FIG. 7.

The FIGS. 7 and 8 indicate the further use of an optional mirror plate 41 for permitting dental inspection, whereupon the mirror plate is of a concave configuration and of flexible construction arranged for reception within a mirror plate housing 43. The mirror plate 41 includes a mirror plate boss 42 positioned within a housing slot 49 within the housing 43, whereupon projection of the mirror plate boss 42 towards a first end of the housing 43, as illustrated in FIG. 8, directs the mirror plate within the housing in closed configuration, whereupon projecting the boss 42 towards a first end of the slot 49, the mirror plate 41 projects from the housing over the fastener dial 18.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pivot head toothbrush, comprising, an elongate rigid support shaft, having a support shaft first end and a support shaft second end, the support shaft first end including an elongate handle, with the handle and the support shaft coaxially aligned along an axis, and the support shaft second end having a support shaft head, with the support shaft head including a support shaft head recess floor and a support shaft head plate parallel to said support shaft recess floor and parallel to said axis, with a brush head, the brush head including a top wall plate, and the top wall plate including a top wall plate shaft orthogonally and medially oriented relative to the top wall plate rotatably directed through the support shaft head, and the top wall plate shaft including a threaded end portion projecting beyond the support shaft head recess floor, with the threaded end portion having a fastener dial threadedly mounted thereon in communication with the support shaft head recess floor, and the fastener dial has a predetermined thickness, and wherein the support shaft head recess floor is spaced from a support shaft top wall a predetermined spacing of said predetermined thickness, and the top wall plate includes a plurality of first ribs that are linearly aligned and radially directed into the top wall plate shaft, and a plurality of second ribs orthogonally oriented relative to said first ribs radially aligned relative to said top wall plate shaft, wherein the second ribs are linearly aligned relative to one another, and wherein the support shaft head face plate includes a plurality of first recesses and a plurality of second recesses, wherein said first recesses receive said first ribs and said second recesses receive said second ribs in a first position of said brush head when the brush head is in a first position, and wherein the first ribs are received within the second recesses and the second ribs are received within the first recesses when the brush head is in the second rotated position, and the handle has a handle reservoir cavity and a handle cap, the handle cap including a compressed gas cartridge to effect pressurizing within said handle reservoir cavity, and a delivery conduit in communication with said reservoir cavity extending through said support shaft, with the delivery conduit having a valve plunger directed through said delivery conduit, with said valve plunger received within a valve plunger cavity having a valve plunger cavity floor, and a spring interposed between the valve plunger and the valve plunger cavity floor, the valve plunger including an annular feed groove to effect communication through said delivery conduit when said valve plunger is directed into said valve plunger cavity, and a further conduit directed through said top wall plate shaft in communication with said delivery conduit, with the further conduit having an outlet port directed through said brush head bottom wall, and a mirror plate housing and a mirror plate received within the mirror plate housing in a reciprocatable relationship, with the mirror plate including a mirror plate boss and the mirror plate housing having a housing slot, with the mirror plate boss received within the slot, with the boss arranged for reciprocation with said slot, and with the mirror plate received within said housing when the boss is oriented at a first end of said slot, and the mirror plate extended from said housing when the boss is oriented at a second end of said slot.

* * * * *